US005240179A

United States Patent [19]

Drinkwater

[11] Patent Number: 5,240,179

[45] Date of Patent: Aug. 31, 1993

[54] ANTI-FREEZE ASSIST APPARATUS

[76] Inventor: Don L. Drinkwater, 235 Fiske St., Carlisle, Mass. 01741

[21] Appl. No.: 797,119

[22] Filed: Nov. 22, 1991

[51] Int. Cl.[5] ..... E03B 7/12

[52] U.S. Cl. ..... 237/80; 137/59; 417/12

[58] Field of Search ..... 237/80; 137/59, 564, 137/624.11; 417/12, 14

[56] References Cited

U.S. PATENT DOCUMENTS

| | | | |
|---|---|---|---|
| 4,457,326 | 7/1984 | Donnelly | 237/80 X |
| 4,672,990 | 6/1987 | Robillard | 137/564 X |
| 4,750,472 | 6/1988 | Fazekas | 417/12 X |

FOREIGN PATENT DOCUMENTS

| | | | |
|---|---|---|---|
| 48204 | 4/1982 | Japan | 237/80 |
| 192736 | 11/1982 | Japan | 237/80 |
| 158433 | 9/1983 | Japan | 237/80 |
| 138383 | 5/1989 | Japan | 417/12 |

*Primary Examiner*—William E. Tapolcai

[57] ABSTRACT

A method and an apparatus to aid in the prevention of pipe freezing. This method utilizes fluid in motion to help pipes resist freezing. When initiated by the control circuit, fluid flows through the pipes to prevent freezing. The control system utilizes either a fixed duty cycle, a variable duty cycle, a duty cycle which can be selected or a temperature sensor. Other apparatus of this sort use the heat produced by electrical current to heat a pipe to prevent freezing. The method and apparatus described here utilizes fluid in motion to accomplish a similar task. This method is particularly suited for hot water circulating types of systems.

8 Claims, 4 Drawing Sheets

ANTI-FREEZE ASSIST APPARATUS

FIELD OF THE INVENTION

The invention is related to the field of preventing liquid holding containers such as pipes from freezing. More specifically, the invention is related to a device and a method to aid in the prevention of pipes from freezing. Although not limited to, the invention is particularly useful when used with a water circulating type of heating system. The method and apparatus when used with such a system and when controlled properly, will protect the zone's pipes from freezing and thus allow selected heat zones to be lowered in temperature without the risk of freezing the pipes. Among other advantageous, when used this way, the invention will serve to conserve energy and will lower equipment maintenance costs.

BACKGROUND OF THE INVENTION

Pipes that are used to carry liquid are subject to damage do to freezing. A variety of methods have been employed to prevent this from happening. One such method is to wrap electric wire around the pipe. The wire conducts current when the pipe gets near a freezing temperature. The disadvantages of this method include installation and electrical energy consumption. Other methods require installation of special valves and/or other mechanical plumbing devices. The disadvantages of these alternatives are the cost of the additional devices and required installation.

Many times the pipes needing protection are part of a heating system which heats a zone by passing water heated in a boiler to a designated zone through pipes. If the pipes pass through an unusually cold area and/or if the heated zone is not calling for heat the pipes may freeze. Providing a device which commands hot water or any liquid to flow before freezing occurs will prevent freezing from occurring.

SUMMARY OF THE INVENTION

It is therefore an object of the invention to provide a method and apparatus which will prevent pipes carrying liquid from freezing.

This and other objects are achieved according to the invention by a device which causes water to flow as requested by a controller. Said controller will initiate the flow of water based upon 1. actual fluid container temperature; 2. predicted fluid container temperature and/or 3. a selected timed duty cycle.

In the first case, an electronic thermal sensitive device is placed on or very near the liquid carrying container, pipe. When electrical signal is passed to the controller. The controller sends the required electrical signal to an electro-mechanical device which causes the liquid to flow through a carrying container such as a pipe. The flow of liquid prevents the liquid carrying container from freezing. Use of a conditioned fluid such as heated water will further prevent freezing from occurring. The controller can be set or programmed to accommodate the requested flow characteristics.

In the second case, a temperature or other sensor can be placed in an environment which causes the sensor to send an electrical signal to the controller under conditions which predict that the liquid carrying container may be subject to freezing. The controller sends the required electrical signal to an electro-mechanical device which causes the liquid to flow through a carrying container such as a pipe. The flow of liquid prevents the liquid carrying container from freezing. Use of a conditioned fluid such as heated water will further prevent freezing from occurring. The controller can be set or programmed to accommodate the requested flow characteristics.

In the third case the controller is set or programmed to send an electrical signal to an electro-mechanical device based upon the selected on/off duty cycle. The duty cycle can range from full on cycles to short on cycles with long durations of off time. When used in this manner, no environmental sensors are required. The electro-mechanical device causes liquid to flow through a carrying container such as a pipe. The flow of liquid prevents the liquid carrying container from freezing. Use of a conditioned fluid such as heated water will further prevent freezing from occurring.

The above and other objectives are also achieved according to the invention by a method controlling an electro-mechanical device which causes liquid to flow through a liquid carrying container. The method comprises the steps of: 1. initiating the requested action either by an environmental sensing device or a program, 2. starting up a timed and duty-cycle selected sequence and providing a compatible electrical signal to initiate the flow of liquid through a liquid carrying device. The device and method according to the present invention provides among other advantages the ability to prevent pipes from freezing while at the same time allowing heating zones to be lowered to temperatures, which without the apparatus described, would not protect the liquid within the pipes from freezing. In addition, if operated in the program duty-cycle mode throughout the year, seasonal maintenance costs associated with restart up of a heating system will be minimized. This is an unexpected advantage of the invention. The invention also maintains a heating system operational during a system thermostat failure. This is a second unexpected advantage.

DETAILED DESCRIPTION

Figure 1:
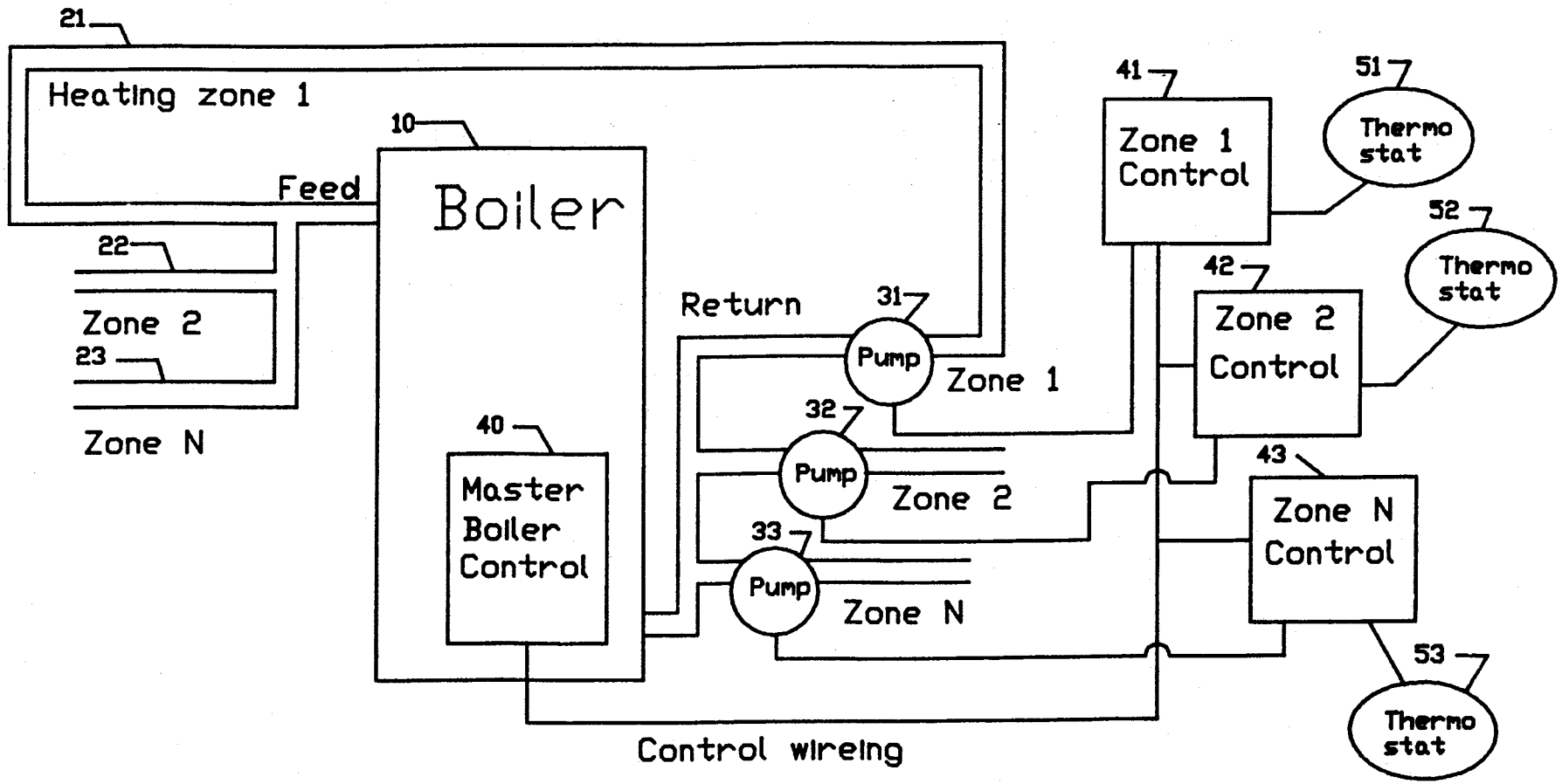
FIG. 1 shows a drawing of a system by which a liquid is used to transfer heat energy to individual zones.

FIG. 1 shows an arrangement of a heating system by which liquid is used to transfer heat energy to a multiple of zones. A single zone system would be equally served by the invention. A boiler 10 is used to heat water or any suitable liquid. Pump 31 provides a method to move the liquid through the pipes 21 which service zone 1. Pump 32 is used in a similar way to move the liquid through the pipes 22 which service zone 2. Pump 33 provides a method to move the liquid through pipes 23 which service yet another zone N. (where N can be any number of zones) This system of pumps and pipes can be extended to service as many zones as required.

The system is controlled by a central master zone control and a multiple of slave controls corresponding to the number of zones and pumps. Each zone control is programed by a thermostat most typically located within the heated area a particular zone services. These components are the embodiment of a typical system. Multiple variations of the described system exist including but not limited to the use of zone solenoid type valves instead of multiple pumps.

Figure 2:
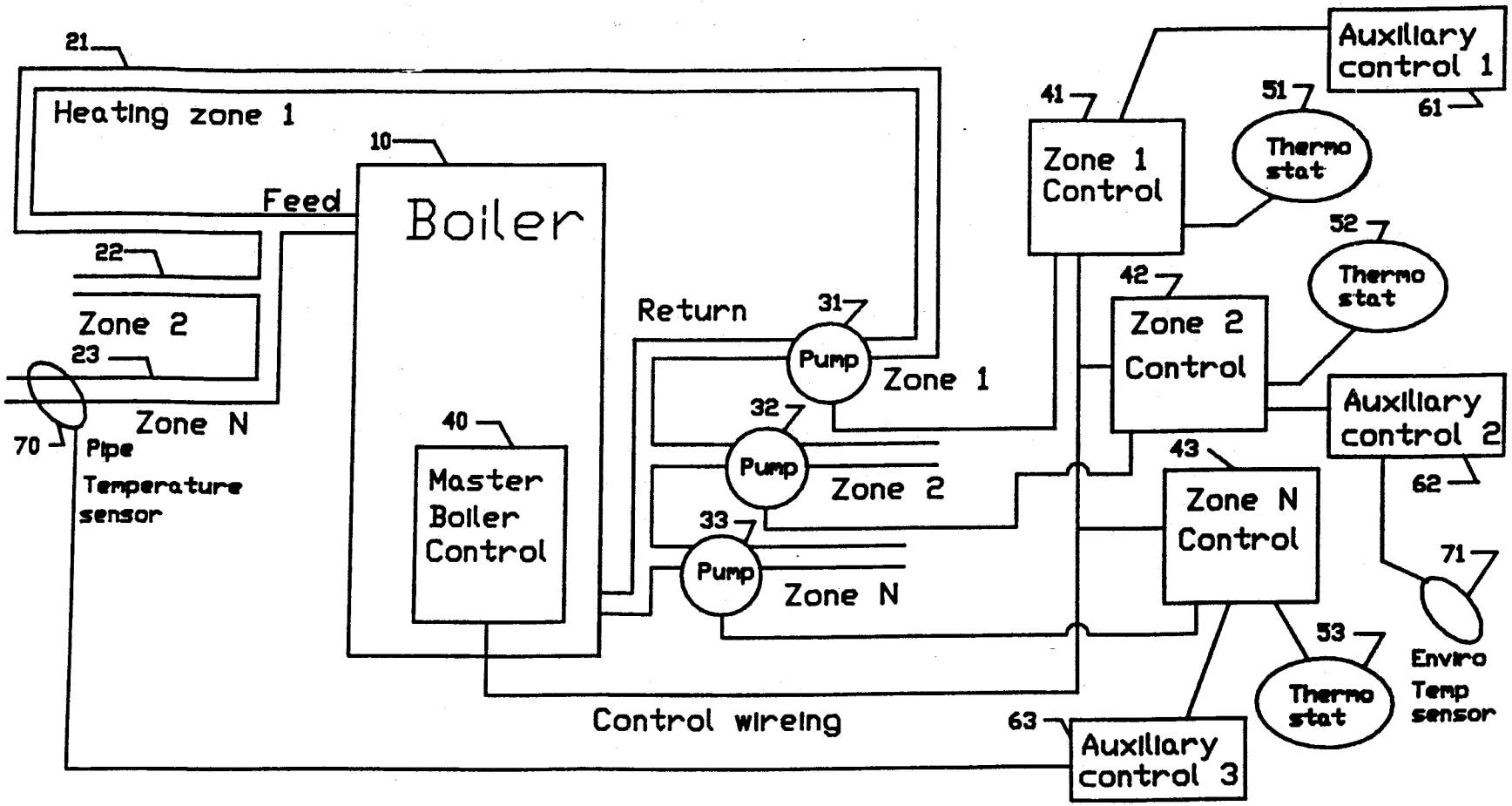
FIG. 2 shows a drawing of a system by which a liquid is used to transfer heat energy to individual zones with the improvements of the present invention.

FIG. 2 shows a similar system with the addition of the present invention. Auxiliary controllers 61, 62 and 63 are added along with optional heat sensors 70 and 71 if desired. One or more heat sensors can be connected to each auxiliary controller. The auxiliary controllers can be integrated if desired into either the master controller or zone controllers. The auxiliary controllers can be programmed to operate in any of the following ways. They are:

1. sensing the actual temperature of the liquid or pipe using temperature sensor 70 and causing the liquid to flow when the temperature gets to low by turning on pump 33 through controllers 43 and or 63.
2. predicting when a potentially freezing liquid temperature may exist using a temperature sensor 71 located strategically and causing the liquid to flow by turning on pump 32 through controllers 42 and or 62 under such conditions.
3. continually cycling the flow of liquid on and off at programmed intervals with a programmed duty cycle. The auxiliary controller turns on pump 31 through controllers 41 and/or 61 to do this.
4. Any combination of the above.
5. Any one or all zones can be programmed to operate in any of the aforementioned ways.

Figure 3:
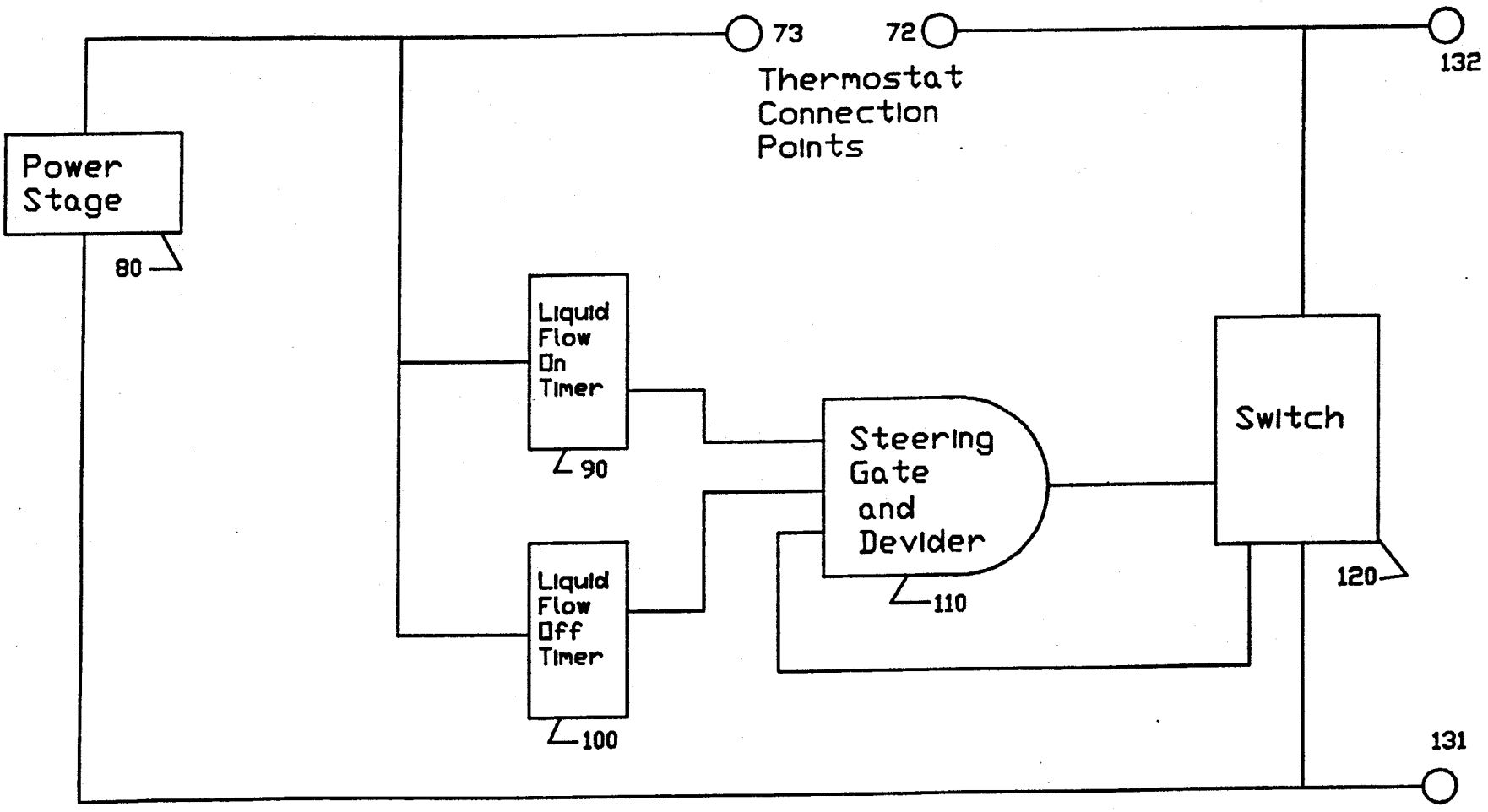
FIG. 3 is a block diagram of a control system to prevent the pipes in FIG. 1 from freezing.

FIG. 3 is a block diagram of the auxiliary controller 61, 62, and or 63 according to the present invention. The major components are a power stage 80, a liquid flow on timer 90, a liquid flow off timer 100, a steering gate and time divider 110, a switch 120, a connection point 131 and a second connection point 132.

The power stage 80 provides the needed energy to the rest of the circuit components. The energy source can be constructed using storage components, power regulation components or any combination of both. The liquid flow on timer 90 controls the amount of time that liquid flows. This timer can be adjustable. The liquid flow off timer 100 controls the amount of time the auxiliary controller 61, 62 or 63 is not requesting liquid to flow. This time can also be made adjustable. The steering gate and time divider 110 divides the on and off timer increments to appropriate amounts and determines which timer is programming the switch. The switch 120 assumes a low impedance state to turn on liquid flow and a high impedance state to turn off liquid flow. The switch can also be designed to momentarily assume a high impedance for a short duration of time while in the low impedance state. Doing this allows the power stage to get bursts of energy and maintain power to the auxiliary controller.

Connection point 131 and connection point 132 are used to connect the auxiliary controller to the zone controller. Thermostat connection points 72 and 73 are used to connect the auxiliary timer to a thermostat 70 or 71. If used, the thermostat turns on the auxiliary controller when a potential freezing condition exists. In a simpler configuration, connection points 72 and 73 are tied together. These points can also be tied to a switch used to manually turn the auxiliary timer on and off. A switch and thermostat connected in series and or parallel provides a variety of operator programmed options.

Figure 4:
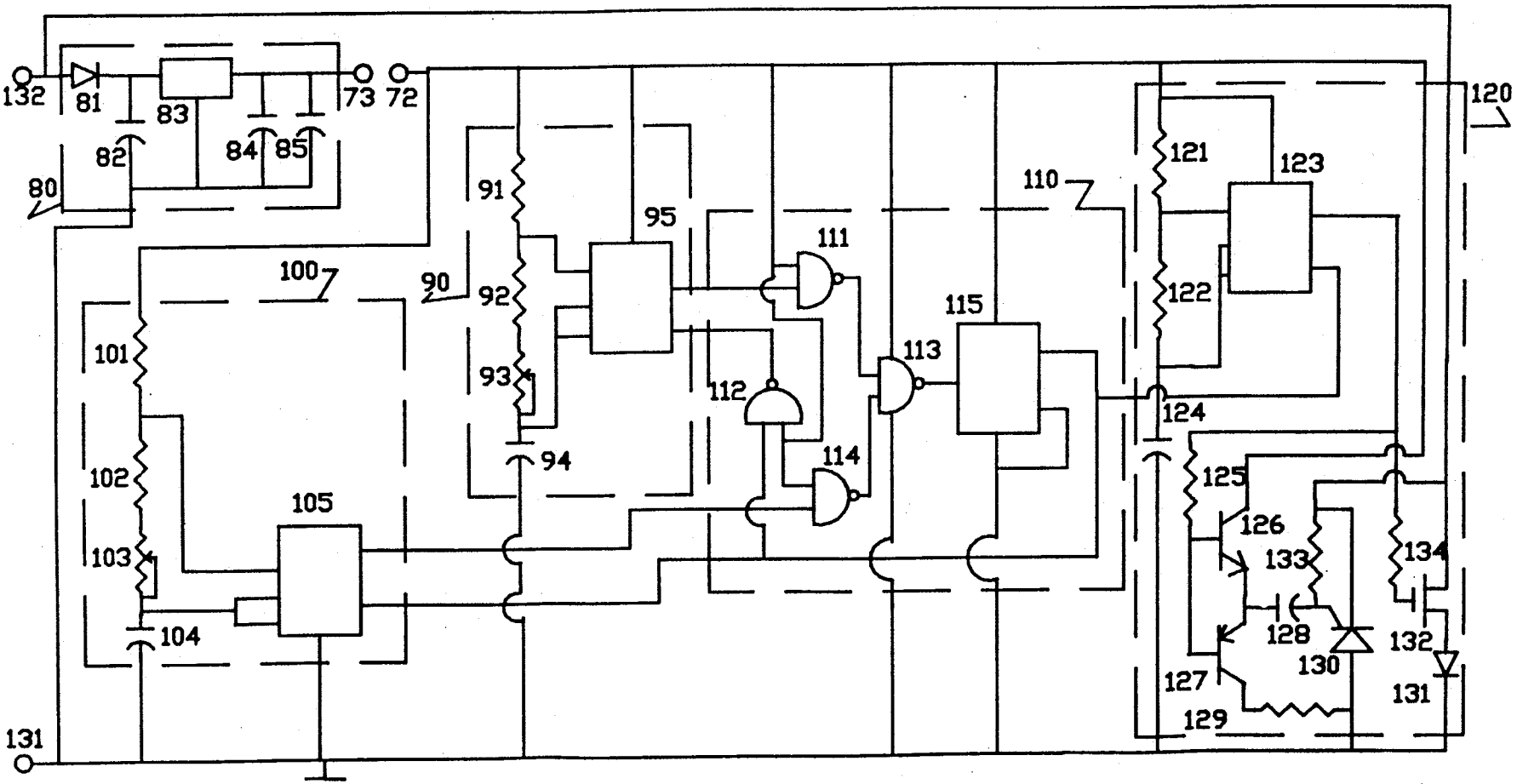
FIG. 4 is a schematic diagram of the control circuit shown in block diagram form in FIG. 2 constructed according to an embodiment of the present invention.

An embodiment of the auxiliary controller 61, 62 or 63 logic circuit according to the invention is shown in FIG. 4. The major components of the logic circuit are a power source 80, a timer 90 which can be set from fifteen minutes to two hours and which purpose is to initiate the flow of liquid, a second timer 100 which can be set from 2 minutes to fifteen minutes and which purpose is to halt the flow of liquid, a steering circuit and timer divider 110 which determines which of the two timers is controlling and divides the time intervals appropriately so that the timers can operate at higher speeds to accommodate integrated timer circuit elements and a switching circuit 120 which is connected to controllers 61, 62 or 63 through contacts 131 and 132.

The power source 80 receives energy from a zone control 41, 42 or 43. Diode 81 and capacitor 82 rectify, filter and provide energy storage for the auxiliary controller. Integrated circuit (83) regulates the filtered voltage to approximately 12 volts. Capacitors (84) and (85) provide additional filtering as well as decoupling for the integrated circuits. Resistors 91 and 92 with potentiometer 93 and capacitor 94 program integrated circuit 95 to form a timer which turns on SCR 130 and FET 132. Potentiometer 93 provides for an adjustable turn-on time. Resistors 101 and 102 with potentiometer 103 and capacitor 104 program integrated circuit 105 to form a timer which turns off SCR 130 and FET 132. Potentiometer 103 provided for an adjustable turn-off time.

To minimize components, the circuits which make timers 95 and 105 are contained within the same integrated package. The same holds for gates 111, 112, 113 and 114. These gates form a steering circuit which activates and steers through the output from the appropriate timer. When the output of 115 is low, the turn on timer integrated circuit 95 is activated. When the output of 115 is high, the turn off timer integrated circuit 105 is activated.

Integrated circuit 115 divides the output of the turn on timer and turn off timer so that they can operate at much higher speeds than would otherwise be required. This minimizes the need for large and precise timer components. Timer 123, resistor 125, transistors 126 and 127, capacitor 128 and resistor 133 form a driving circuit for SCR 130. Timer 123, and resistor 134 form a driving circuit for FET 132. Diode 131 prevents current from flowing in a reverse direction through FET 132.

The switching circuit 120 contains a few unique features. Whenever the circuit receives a high signal from the steering gate and timer divide circuit 110, switching circuit 120 begins to oscillate at 1 Khz with a 90% duty cycle. This oscillation and duty cycle perform two tasks. First the pulsing oscillations drive SCR 130 on through capacitor 128, resistor 133, transistors 126 and 127 and resistor 125. SCR 130 is required to conduct current during the negative one half cycle of a sine wave if such a sine wave is being sent to the auxiliary controller by the zone controller to be controlled. Second, these same pulsing oscillations drive FET 132 on for 90% of the time and off for 10% of the time. Doing this gives capacitor 82 a brief recharge through diode 81 in order to maintain power to the auxiliary controller. FET 132 conducts the positive one half sine wave if a sine wave is present or a DC current if a DC current is being sent to the auxiliary controller from the zone controller for control. In either case power is always maintained to the auxiliary controller. If this pulsing feature were not present, the auxiliary controller would either require an extremely large capacitor 82 or a battery.

When timer 123 oscillates the contacts 131 and 132 are put in a low impedance state by SCR 130 and FET 132. This serves to request the flow of liquid through the respective zone controller and desired mechanical apparatus. SCR 130 and FET 132 are turned off whenever the output of timer 123 goes low.

What is claimed is:

1. A device to prevent the liquid resident in liquid carrying conduits from freezing, comprising:

(a) a means to cause said liquid within said conduits to flow, and (b) a controlling device having a programmable flow on timer and a programmable flow off timer, (c) an ambient temperature measurement device connected to said controlling device for activating said controlling device when the ambient temperature approaches freezing, (d) said controlling device being electrically connected to said means of causing the flow of said liquid within the said conduits to cycle said liquid flow on and off at specified time periods to prevent said liquid resident in said conduits from freezing.

2. The device of claim 1 wherein said liquid is heated.

3. The device of claim 1 wherein a means of supplying DC voltage to the circuits within the controlling device is provided.

4. The device of claim 3, wherein said DC voltage includes an energy storage component capable of maintaining auxiliary controller functionality at all times.

5. The device of claim 1, wherein said timers comprise two integrated timers, one said timer to control the said on duration of time, the other said timer to control the said off duration of time.

6. The device of claim 5, wherein a steering gate is used to activate each of said integrated timers.

7. The device of claim 1, wherein a triac and a field effect transistor provide an appropriate impedance to activate said means to cause said liquid to flow within said conduits.

8. The device of claim 5, wherein said integrated timers are constructed using a dual integrated timer.

* * * * *